US006149467A

United States Patent [19]

Choy

[11] Patent Number: 6,149,467

[45] Date of Patent: Nov. 21, 2000

[54] CONTACT ARRANGEMENT FOR USE WITH HIGH SPEED TRANSMISSION

[75] Inventor: Edmond Choy, Union City, Calif.

[73] Assignee: Hon Hai Precision Ind. Co., Ltd., Taipei, Taiwan

[21] Appl. No.: 09/149,884

[22] Filed: Sep. 8, 1998

[51] Int. Cl.[7] ..... H01R 24/00

[52] U.S. Cl. ..... 439/637; 439/515

[58] Field of Search ..... 439/637, 630, 439/636, 515, 80–84; 336/73

[56] References Cited

U.S. PATENT DOCUMENTS

| | | | |
|---|---|---|---|
| 3,631,381 | 12/1971 | Pittman | 439/637 |
| 4,370,017 | 1/1983 | Grabbe et al. | 439/515 |
| 4,701,002 | 10/1987 | Mouissie | 439/630 |
| 4,721,348 | 1/1988 | Mouissie | 439/630 |
| 4,941,832 | 7/1990 | Korsunsky et al. | 439/515 |

FOREIGN PATENT DOCUMENTS

| | | | |
|---|---|---|---|
| 964839 | 7/1964 | United Kingdom | 439/637 |

*Primary Examiner*—Paula Bradley
*Assistant Examiner*—Briggitte R. Hammond

[57] ABSTRACT

A high speed connector (10) includes an insulative housing (12) defining a central slot (14) with two rows of passageways (16) by two sides thereof wherein each passageway (16) receives a contact (18) therein. Each contact (18) includes a base (20) with retention means (24) for interferentially engaging the contact (18) within the corresponding passageway (16). From the base (20), a main arm (26) extends upwardly toward and into the central slot (14), and an auxiliary arm (28) extends upward spaced from the main arm (26) and also spaced from the outer wall (30 in the passageway (16). When the module (100) is inserted into the central slot (14), the module (100) first engages the main arm (26) and pushes the main arm (26) outwardly. The main arm (26) successively engages the corresponding auxiliary arm (28) aside and pushes the auxiliary arm (28) outwardly. Therefore, when the module (100) is fully received within the central slot (14), the main arm (26) and the auxiliary arm (26) are both deflected outward and engaged with each other.

1 Claim, 2 Drawing Sheets

CONTACT ARRANGEMENT FOR USE WITH HIGH SPEED TRANSMISSION

BACKGROUND OF THE INVENTION

1. Field of The Invention

The invention relates to a card edge connector, and particularly to contact arrangement thereof so as to meet the requirements of high speed transmission.

2. The Related Art

DIMM (Dual In-line Memory Module) connectors are now popularly used in the personal computers. The typical DIMM connector is of substantially a card edge connector with two ejectors at two opposite ends thereof. The most common type contact used in the DIMM connector is of a single beam type as shown in U.S. Pat. No. 5,470,242 in which the contact is deflectably engaged with the corresponding circuit pad on the inserted module.

Generally speaking, this arrangement is okay for the traditional card edge or DIMM connector. While recently, the high speed transmission is required in the personal computer, and thus such style contact is no longer acceptable in that situation because of the inductance of the contact being regarded too high. Therefore, how to lower the inductance of the contact is a key thing for the high speed connector.

Basically, increasing the cross-section area of the contact to reduce the electrical resistance is an ideal way to lower the corresponding inductance thereof. While oppositely, increasing the cross-section area also increases the spring constant K of the contact from a mechanical viewpoint, thus improperly increasing the undesired insertion force between the inserted module and the corresponding contact.

Anyhow, in an earlier years there were some other type contacts of the so-called PLCC connectors wherein each contact generally included a moveable arm and an immovable arm wherein the moveable arm was adapted to be deflected and slidably engaged with the immovable arm so as to attain a shorter signal path through the immovable arm while still owning thereof superior mechanical resiliency substantially provided by the moveable arm for mechanical and electrical engagement with the electrical component embedded within the connector socket. Under that situation, those two moveable and immovable arms can be deemed as in a parallel relationship from an electrical viewpoint, and thus the integral inductance L of the contact can be lowered in comparison with the single moveable arm arrangement, with reference to Equation: $1/L_t$(total) is equal to $1/L_m$ (moveable arm) plus $1/L_i$(immoveable arm), for example, U.S. Pat. Nos. 4,354,729, 4,504,887 and 4,684,184.

Nevertheless, such an arrangement can not be directly applied to the card edge connector, which requires a low insertion force of the inserted module, because of the high insertion force derived from the immovable arm.

Therefore, an object of the invention is to provide a card edge connector for use with high speed transmission wherein the contact arrangement in the connector can achieve not only a lower inductance thereof but also a lower insertion force, both of which are required in the high speed connector.

SUMMARY OF THE INVENTION

According to an aspect of the invention, a high speed connector includes an insulative housing defining a central slot with two rows of passageways by two sides wherein each passageway receives a contact therein. Each contact includes a base with retention means for interferentially engaging the contact within the corresponding passageway. From the base, a main arm extends upwardly toward and into the central slot, and an auxiliary arm extends upward spaced from the main arm and also spaced from the outer wall in the passageway. When the module is inserted into the central slot, the module first engages the main arm and pushes the main arm outwardly. The main arm successively engages the corresponding auxiliary arm aside and pushes the auxiliary arm outwardly. Therefore, when the module is fully received within the central slot, the main arm and the auxiliary arm are both deflected outward and engaged with each other.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
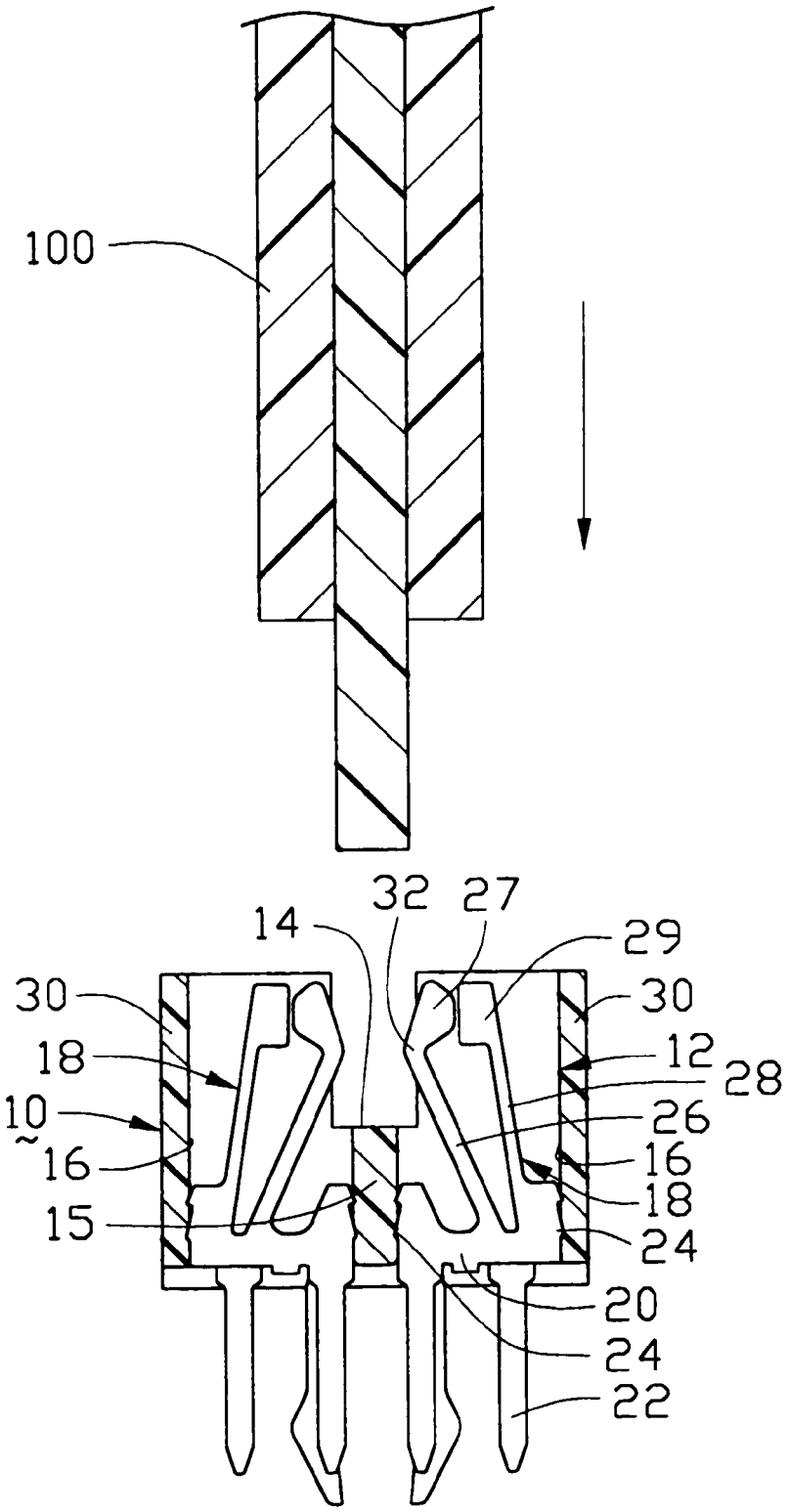
FIG. 1 is a cross-sectional view of a presently preferred embodiment of a connector and an associated module, according to the invention, wherein the module has not been inserted thereinto.
Figure 2:
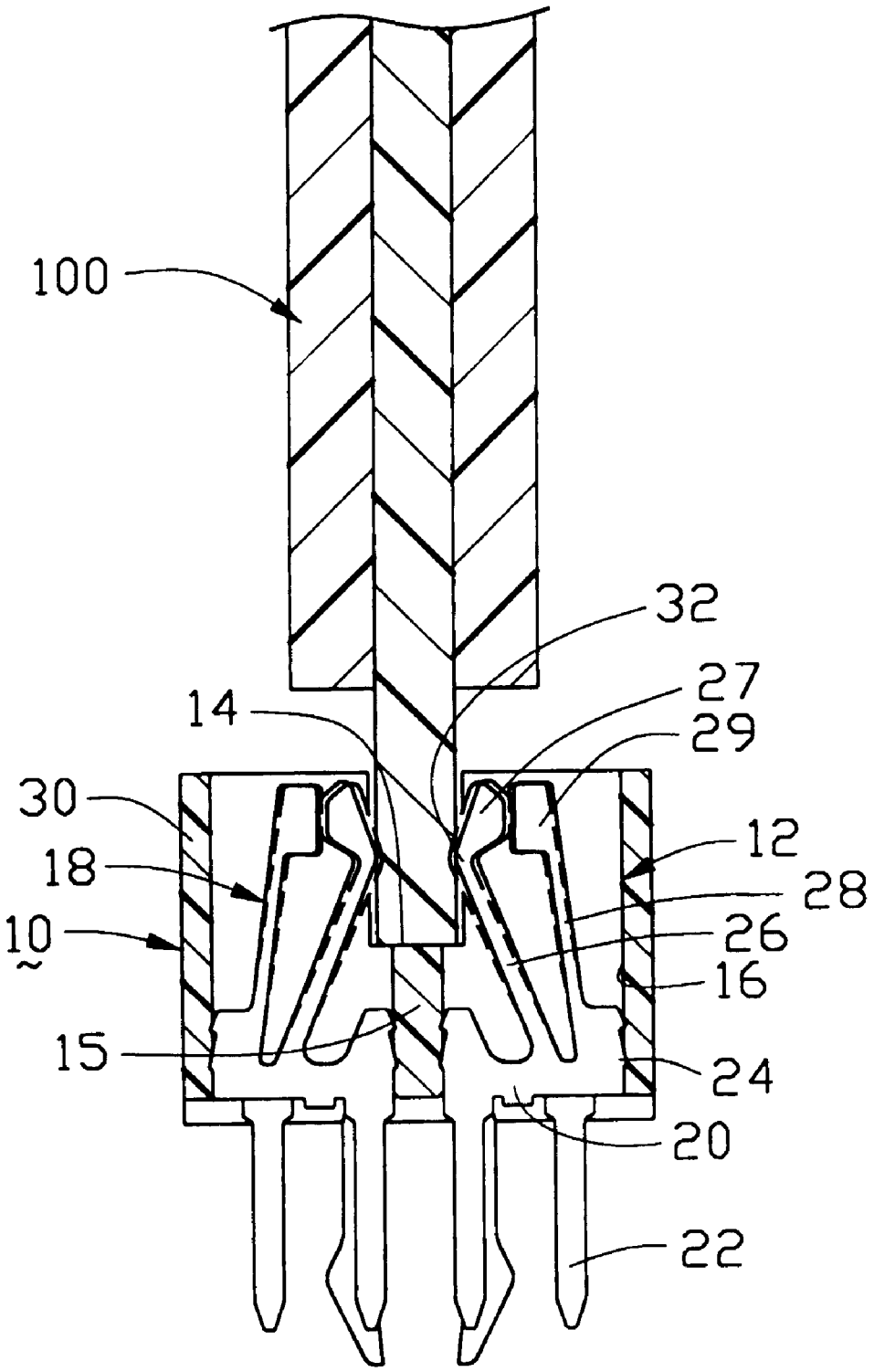
FIG. 2 is a cross-sectional view of the connector and the associated module of FIG. 1 wherein the module has been received therein.

It will be noted here that for a better understanding, most of like components are designated by like reference numerals throughout the various figures in the embodiments. Attention is directed to FIGS. 1 and 2 wherein a card edge connector 10 includes an insulative housing 12 defining therein a central slot 14 extending along the lengthwise housing 12. Two rows of passageways 16 are provided by two sides of the central slot 14 for receiving a corresponding number of contacts 18 therein, respectively. Each passageway 16 is substantially defined between a central rib 15 and an outer wall 30. It is understood that the basic structure of the housing 12 can be referred to the aforementioned U.S. Pat. No. 5,470,242, and the disclosure of which hereby is incorporated by reference.

Each contact 18 includes a base 20 from which a tail 22 extends downward for engagement with the corresponding hole in the mother board (not shown) on which the connector 10 is mounted. Oppositely, a pair of barb sections 24 are provided on two sides of the base 20 for interferential engagement within the passageway 16. A main arm 26 close to the central slot 14, extends from the base 20 toward and into the central slot 14, while an auxiliary arm 28 close to the outer wall 30 of the housing 12, extends from the base 20 upward, wherein the auxiliary arm 28 is spaced from not only the main arm 26 but also the outer wall 30 and the auxiliary arm and the main arm are substantially the same size.

Therefore, when the module 100 is inserted into the central slot 14, the module 100 first engages the main arm 26 and deflects the main arm 26 outwardly. The main arm 26 successively engages the auxiliary arm 28 and deflects the auxiliary arm 28 outwardly. When the module 100 is fully embedded within the central slot 14, the main arm 26 and the auxiliary arm 28 are both deflected outwardly and engaged with each other. In FIG. 2, the dashed lines show the main arm 26 and the auxiliary arm 28 in an un-deflected manner when the module 100 is not inserted into the housing 12, and the solid lines show both of them in a deflected manner when the module 100 is fully inserted into the housing 12. It is noted that in this embodiment, at the final stage, the auxiliary arm 28 is still spaced from the outer wall 30 even though it has been deflected by engagement with the main arm 26.

It is noted that after the module 100 is fully received within the connector 10, the inductance of the contact 18 can be efficiently lowered because two parallel electrical paths are formed by the main arm 26 and the auxiliary arm 28, and the total inductance L can be lowered by following the Equation: $1/L_T$ (total inductance) is equal to the sum of $1/L_M$ (inductance of main arm 26) and $1/L_A$ (inductance of auxiliary arm 28), from the electrical viewpoint.

From the mechanical viewpoint, the insertion force of the module 100 can be dividably expressed by two stages wherein in the first stage, only the main arm 26 is actuated so that only the spring constant $K_M$ (constant of main arm 26) is involved therein. Thus, less forces are required for insertion. Differently, in the second stage, both the spring constant $K_M$ (constant of main arm 26) and $K_A$ (constant of auxiliary arm 28) are involved therein. Thus, more forces are required for insertion. In other words, at the first stage the total spring constant K1 is equal to $K_M$, while at the second stage the total spring constant K2 is equal to $K_M+K_A$.

Similarly, from an electrical viewpoint, at the first stage the total inductance L1 is equal to $L_M$ while at the second stage the inductance L2 is equal to the reciprocal of the sum of $1/L_m$ plus $1/L_A$ as mentioned in an earlier time.

The arrangement of the contact 18, i.e., providing a flexible cantilever type main arm 26 extending into the central slot 14, and a flexible cantilever type auxiliary arm 28 spaced from and between the main arm 26 and the outer wall 30, performs two stage mechanical/electrical engagements (i.e., without mechanical/electrical engagement during the first stage while with mechanical/electrical engagement during the second stage), and a final parallel two-path electrical transmission, and is adapted to be used with a high speed card edge or DIMM connector which requires a lower inductance and a lower insertion force. This arrangement is different from that of the aforementioned one moveable arm incorporating one stationary arm in the so-called PLCC socket connector, and should be uniquely configured to comply with mechanical and electrical characteristics of the high speed card edge connector.

It is noted that in this embodiment, the main arm 26 extends obliquely and upward toward the central slot 14 with a contact apex 32 projecting into the central slot 14 for engagement with the inserted module 100. The main arm 26 further includes an enlarged head 27 extending toward the corresponding auxiliary arm 28. Correspondingly, the auxiliary arm 28 includes an enlarged head 29 extending toward the main arm 26 so that when the main arm 26 is actuated to move outward/lateral by the inserted module 100, the enlarged head 27 of the main arm 26 and the enlarged head 29 of the auxiliary arm 29 can be successively engaged with each other to initiate a mechanical and electrical engagement therebetween.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

I claim:

1. A card edge connector for connecting a module which provides high speed transmission, comprising: an elongated insulative housing defining a central slot extending along a lengthwise direction of the housing; two rows of passageways provided at two sides of the central slot;

a plurality of contacts received within corresponding passageways, each of said contacts including a base secured in the corresponding passageway, a main arm extending upwardly from the base toward and into the central slot, an auxiliary arm extending upwardly, independently and separately with regard to the main arm, from the base between an outer wall of the housing and the main arm, a portion of the main arm other than the base being contactable with the auxiliary arm and thereby providing parallel electrical paths for transmitting signals from the module to the base when the module is fully received in the central slot;

wherein the auxiliary arm and the main arm are substantially the same size, and the auxiliary arm is spaced from not only the main arm but also the outer wall, the auxiliary arm is spaced from the main arm when the module is not received within the central slot, but is engaged with the main arm and deflected toward the outer wall when the module is fully received within the central slot and the main arm is deflected toward the auxiliary arm; and the connector further includes a central rib under the central slot so that each of said passageways is defined between the central rib and the outer wall.

* * * * *